United States Patent [19]

Chambers

[11] 4,275,849

[45] Jun. 30, 1981

[54] MACERATOR

[76] Inventor: William M. Chambers, 14404 Gramercy Pl., Gardena, Calif. 90249

[21] Appl. No.: 363,875

[22] Filed: May 25, 1973

[51] Int. Cl.[3] ..... B02C 23/36

[52] U.S. Cl. ..... 241/46.06; 241/222; 241/236

[58] Field of Search ..... 241/46.06, 46.11, 81, 241/235, 236, 221, 222, 227, 46.17

[56] References Cited

U.S. PATENT DOCUMENTS

| | | | |
|---|---|---|---|
| 1,355,021 | 10/1920 | Waller | 241/236 |
| 1,477,502 | 12/1923 | Killick | 241/236 |
| 2,245,632 | 6/1941 | Winkler | 241/46.06 |
| 2,828,082 | 3/1958 | Veen | 241/46.06 X |
| 3,396,914 | 9/1968 | Liebman | 241/236 |
| 3,658,262 | 4/1972 | Burant | 241/46.11 X |
| 3,664,592 | 5/1972 | Schweigert et al. | 241/236 UX |
| 3,738,581 | 6/1973 | Gallauresi et al. | 241/46.11 X |

FOREIGN PATENT DOCUMENTS

| | | | |
|---|---|---|---|
| 55285 | 6/1935 | Norway | 241/236 |

*Primary Examiner*—Howard N. Goldberg
*Attorney, Agent, or Firm*—Allan M. Shapiro

[57] ABSTRACT

Macerator housing has a flange at each end and a flow channel therebetween so that the macerator can be connected into a sewage line for flow therethrough. A pair of power-driven shafts are mounted transversely to the flow direction and each carries a plurality of interengaging spaced macerator cutters thereon. The macerator cutters do not reach the outer housing walls, but there is a bypass flow space therearound. Screens are positioned on the inlet side of the housing to direct flow into the macerator cutters, but the screens permit fluid flow through the bypass space around the macerator cutters.

8 Claims, 2 Drawing Figures

MACERATOR

BACKGROUND OF THE INVENTION

1. Field of the Invention

This invention is directed to a macerator particularly useful for chopping solids flowing through a mixed sewage line.

2. Description of the Prior Art

It has been found helpful in sewage processing to reduce the size of solids flowing in a mixed flow sewage line. When macerated or comminuted to a smaller physical size, they can be more readily acted upon in the usual sewage treatment facilities. The anaerobic bacterial processing, of course, can be more rapidly achieved with smaller physical dimensions to the solids involved.

Comminuters of various types are known in the art. Prior comminuters do not achieve a desirable goal which is very helpful in sewage line treatment. This goal is to permit bypass of the stream flow past the macerator blades when the blades are not being powered so that flow is achieved in both powered and unpowered circumstances.

SUMMARY OF THE INVENTION

In order to aid in the understanding of this invention, it can be stated in essentially summary form that it is directed to a macerator. The macerator comprises a housing having a flow passage therethrough and macerator cutter carrying shafts extending through the flow passage transversely to the flow direction. There is bypass flow space around the cutters and a bypass screen in the bypass flow space to direct flow toward the macerator cutters.

It is, accordingly, an object of this invention to provide a macerator for mixed flow sewage for macerating the solids in the sewage flow. It is a further object to provide a macerator which has powered rotating macerator cutters and a bypass flow space around the macerator cutters for flow through the macerator when the macerator cutters are not powered. It is another object to provide a bypass screen in the bypass flow space for directing solids in the mixed flow stream toward the macerator cutters.

It is another object to provide a macerator structure where the movable parts can be readily removed and installed in the main housing. It is a further object to provide a readily disassemblable macerator structure for convenience of repair and replacement of parts. It is yet another object to provide a macerator structure wherein the movable parts can be readily removed and reinserted in a different orientation so that the macerator can be partially assembled at the installation site for sewage flow in either direction through the housing.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

DESCRIPTION OF THE PREFERRED EMBODIMENT

Figure 1:
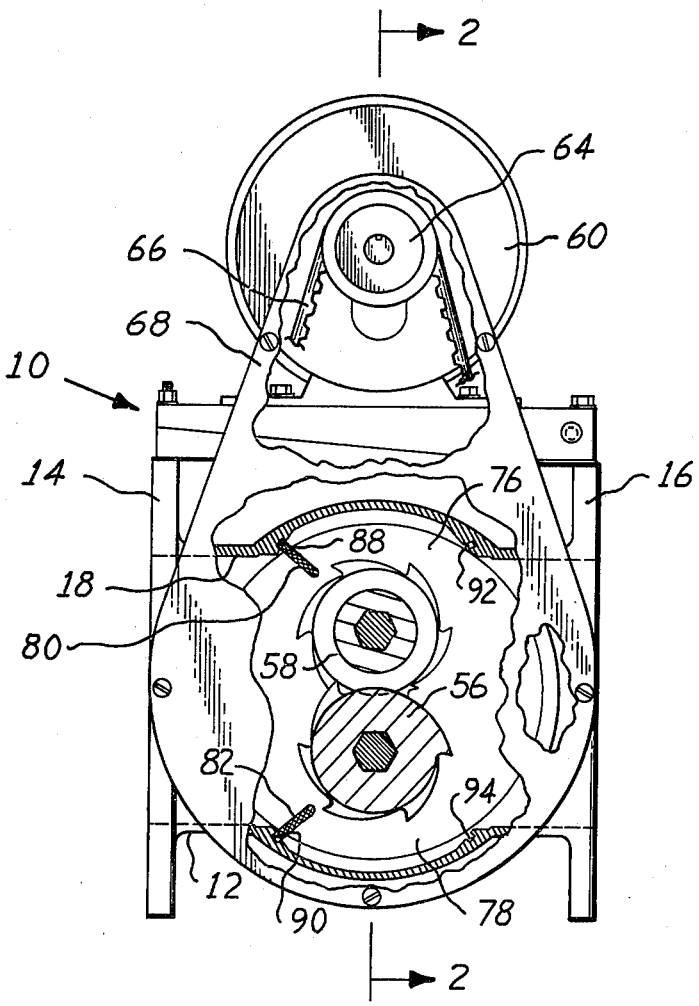
FIG. 1 is an end elevational view, looking transverse to the flow direction, with parts broken away and parts taken in section, of the macerator of this invention.

The macerator of this invention is generally indicated at 10 in the drawings. Macerator 10 comprises a housing 12 with means to fasten the housing in a sewage line. In the particular embodiment illustrated, the attachment means comprises flanges 14 and 16. It is clear from plumbing practice that other securement means are possible, but flanged construction is considered desirable, particularly where the flanges are of standard dimension so that the macerator can be easily installed in a standard sewer line. In other cases, other types of securement for use with cast-iron copper and plastic plumbing can be used. However, in sewage processing installations, flanged joints are most common and thus the macerator 10 is illustrated as being equipped with such fittings. Flow passageway 18 extends through the housing from end-to-end thereof for the passage of mixed flow sewage therethrough when the macerator is connected into the sewage line. Flow passageway 18 generally defines the flow direction, which is from left-to-right in FIG. 1.

Figure 2:
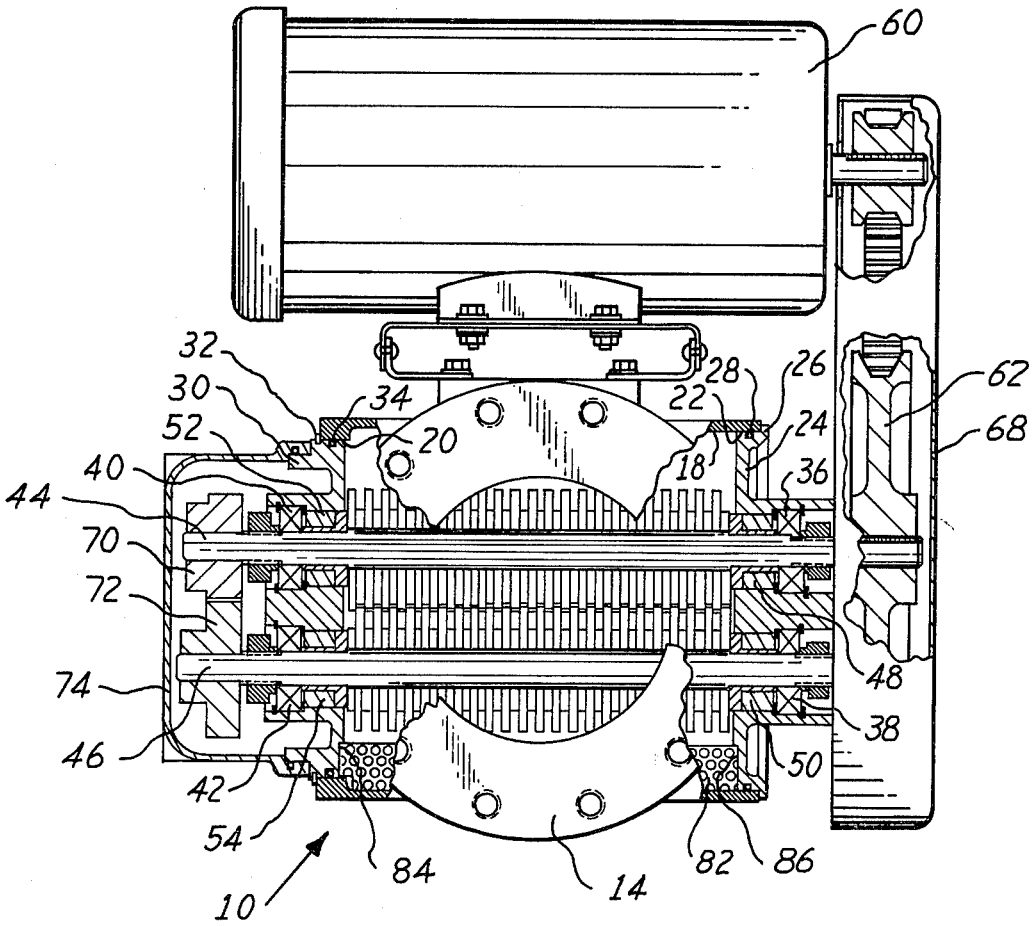
FIG. 2 is a side elevational view, with parts broken away and parts shown in section taken generally along the line 2—2 of FIG. 1.

FIG. 2 illustrates machinery ports 20 and 22 which are circular openings into the housing in a direction transverse to the flow direction. These machinery port openings are circular for convenience of manufacture of the parts and for convenience of sealing therein. Bearing plate 24 fits within machinery port 22, and its entrance therein is stopped by means of exterior flange 26. Sealing is accomplished by means of O-ring 28. Similar bearing plate 30 is inserted into machinery port 20 and its inward motion is limited by means of snap ring 32 which is installed in a suitable snap ring groove in the bearing plate. Sealing is accomplished by means of conventional O-ring 34. Bearings 36 and 38 are mounted in bearing plate 24. Similar bearings 40 and 42 are mounted in bearing plate 30. Shaft 44 extends through bearings 36 and 40, while shaft 46 extends through bearings 38 and 42. The bearings are respectively provided with seals 48, 50, 52, and 54 to prevent contaminants from entering the bearings from flow passageway 18.

As seen in FIG. 1, shafts 44 and 46 are of non-circular, e.g., hexagonal cross section. Alternately spaced along both of these shafts are cutters 56 and spacers 58. The cutters 56 are each provided with an interior bore to fit the non-round character of the shafts in which they are mounted so that, with rotation of the shafts, the cutters rotate. In the particular case, the cutters each have the appearance of a very coarse-bladed saw, or a multistep cam. The spacers 58 are of slightly greater thickness than the cutters so that the cutters on one shaft can lie between the cutters on the other shafts. This alternated arrangement is shown in FIG. 2. The alternated arrangement provides for comminuted maceration of solids which are delivered to the inter-engaging cutters when the cutters are rotating. Additionally, this structure is self cleaning.

Normal rotation, for a flow from left-to-right, is counter-clockwise rotation of shaft 44 and clockwise rotation of shaft 46, as they are seen in FIG. 1. Rotation is provided by means of motor 60 which is mounted upon the top of housing 12 by means of a convenient motor mount. Shaft 44 carries drivewheel 62 on its outboard end outside of the bearing 36. Motor 60, similarly, carries drivewheel 64. The drivewheels are connected by a suitable driver 66. In the present case, the drivewheels are V-belt pulleys, and connector 66 is a V-belt. In other cases, multiple V-belts, cogbelts, chains, or gear drives can be used, if desired. However, belt drives ae preferred, because adequate power can be transmitted economically. Furthermore, belt drives provide quiet operation and ease of maintenance. Belt guard 68 prevents personnel injury by the drive mechanism.

The rear end of shaft 44 carries gear 70, while the rear end of shaft 46 carries mating gear 72. These gears are preferably of different diameter so that the macerator shafts rotate at different speeds to enhance tooth inter-engagement action of the cutters. By this means, the cutters on both shafts are driven. Cover 74 is mounted over the gears to form a gear housing, both to maintain lubricant in the gear housing and to minimize personnel risks from the gears.

As is best seen in FIG. 1, there is a bypass flow space 76 above the cutters on shaft 44 and a bypass flow space 78 below the cutters on shaft 46. These spaces are sufficient, together with the spaces between the cutters, that the open cross section for flow through the housing 12 at the center of the structure along section line 2—2 is at least as large as the opening through either of the flanges 14 and 16. Thus, there is no reduction in area to cause flow restriction through flow passage 18 through the macerator, even if the cutters are not rotating. However, in order to direct solids in the flow stream into the inter-engagement of the cutters when the cutters are rotating, bypass screens 80 and 82 are provided. As is seen in FIG. 2, the openings in the bypass screens are sufficiently large that the normal liquid flow can directly pass through the screens of the macerator, while solids are directed into the cutter inter-engagement. Bypass screens 80 and 82 are mounted in slots 84 and 86, respectively, in bearing plates 30 and 24. They are limited in inward direction by the termination of these slots. The bypass screens are also mounted in slots 88 and 90 in housing 12, see FIG. 1.

In order to aid in the manufacture of the macerator, provide ease and economy of maintenance, and minimize down time, the parts are all mounted upon a single assembly, which includes bearing plates 24 and 30. When belt guard 68 and belt 66 are removed, and snap ring 32 is removed from its groove, the entire assembly carried on the bearing plates can move out of the housing 12 to the right, as seen in FIG. 2. Furthermore, the bypass screens slide out of their slots 88 and 90 simultaneously when the equipment assembly is withdrawn. Upon such withdrawal, a spare assembly can be installed. On the other hand, the moving part assembly thus described can be removed from service for repair without unbolting the flanges 14 and 16 from the line. Thus, even without a spare assembly, repairs can be quickly made on the bench with a minimum down time.

In order to eliminate the need for different units as may be required for different assembly conditions, it will be noted that the motor 60 is mounted in fixed relation to the housing 12 so that the entire unit can be installed in any rotated position about the centerline of fluid flow or the centerline 90° therefrom through the moving part assembly. Furthermore, for flow from right-to-left in FIG. 1, screens 80 and 82 are placed in slots 92 and 94 to provide the required control over the solids in the sewage stream. In this way, the same unit can be assembled for flow in either direction, and this is especially useful for processing stations where revisions in flow path are being made. This provision can permit use of the macerator in different service conditions.

It is clear from this description that the macerator 10 can be built in different sizes, depending upon the line size and flow capacity. In each case, adequate bypass flow space 76 and 78 is provided so that an open flow area through the center of the macerator is at least equal to the size of the flow passage 18 at the connector. The bypass screens are required when this bypass flow space is provided.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. Apparatus for shredding solid debris passed along a sewage conduit, comprising:

a shredder assembly including cooperating substantially parallel first and second shredding stacks respectively having a plurality of first concentric knives mounted on a first shaft in interspaced relationship with a plurality of second knives mounted concentrically on a second shaft, said first and second stacks being compressed between first and second distally opposed bearing plates having received therein for rotation said first and second shafts, said bearing plates being secured in compression against said stacks by compression nuts threadably engaging the distal ends of said shafts;

a housing conformed to receive in telescoping cooperation said shredder assembly including transversely opposing tubular sections adapted to be secured to said sewage conduit;

securing means adapted to be attached to said shredder assembly for securing thereof in said housing;

directing means disposed longitudinally along the interior of said housing in converging receiving alignment with one said tubular section for directing the debris received therein into said shredder assembly;

gearing means disposed on adjacent one ends of said first and second shafts for coupling the rotations thereof in common; and drive means adapted to connect to the other end of said first shaft for driving said shaft in rotation.

2. Apparatus according to claim 1 wherein:

said directing means includes vanes disposed within said housing dimensionally conformed to extend proximate said first and second stacks terminating thereat to provide a predetermined maximum clearance relative the corresponding knives thereof, said vanes further including a plurality of openings dimensionally conformed to the dimensions of said clearance.

3. Apparatus according to claim 1 wherein:

said drive means includes an electric motor operatively disposed in substantially parallel alignment with the longitudinal axis of said housing, adjustable means interposed between the adjacent exterior surfaces of said motor and said housing for selectively adjusting the separation between the central axes thereof and pulley means connected between the proximate end of said motor and the other end of said first shaft.

4. Apparatus according to claim 1 wherein:

said first and second knives comprise helical plan form structures concentrically mounted in selective index on said first and second shafts having a chord edge joining between the exterior and interior peripheries of said helix aligned to form an acute angled projecting tooth.

5. Apparatus according to claim 1 further comprising:

sealing means disposed between said shredder assembly and said housing.

6. Apparatus according to claim 1 wherein:

the distal ends of said transversely opposing tubular sections terminate in flanges adapted to be secured in axial alignment with said conduit at selected angular index therewith.

7. Apparatus according to claim 1 wherein:

said first bearing plate extends to form a peripheral flange around the distal periphery thereof and said second bearing plate extends to form a ring groove around the periphery thereof for receiving a retainer ring at a longitudinal separation from said peripheral flange conforming to the longitudinal dimension of said housing.

8. Apparatus according to claim 1 wherein:

said first plate and the other end of said housing are conformed for mating at a diameter greater than the conforming diameter of said second plate and the one end of said housing for providing telescoping receipt of said shredder assembly in said housing.

* * * * *